United States Patent [19]

Beuchat et al.

[11] 4,300,452

[45] Nov. 17, 1981

[54] DEVICE FOR TRANSMITTING SIGNALS BY MAGNETIC INDUCTION TO PROJECTILE FUSE

[75] Inventors: Roger Beuchat, Gland; Remy Damond, Nyon, both of Switzerland

[73] Assignee: Mefina S.A., Fribourg, Switzerland

[21] Appl. No.: 86,315

[22] Filed: Oct. 19, 1979

[30] Foreign Application Priority Data

Oct. 30, 1978 [CH] Switzerland ..... 11164/78

[51] Int. Cl.[3] ..... F42C 17/00

[52] U.S. Cl. ..... 102/270; 89/6; 102/209

[58] Field of Search ..... 102/209, 206, 270; 89/6, 6.5

[56] References Cited

U.S. PATENT DOCUMENTS

| | | | |
|---|---|---|---|
| 2,465,351 | 3/1949 | Busignies et al. | 102/209 |
| 2,555,384 | 6/1951 | Watt | 102/209 |
| 3,967,554 | 7/1976 | Troyer, Jr. | 102/209 |
| 4,022,102 | 5/1977 | Ettel | 89/6.5 |
| 4,142,442 | 3/1979 | Tuten | 89/6.5 |

*Primary Examiner*—Charles T. Jordan

*Attorney, Agent, or Firm*—Groff, Jr. Emory L.

[57] ABSTRACT

A device for transmitting signals to a projectile fuse (1) by induction comprises a coil (5) for emitting an energy signal picked-up by a coil (3) inside the fuse. This coil (3) is wound on a first magnetic core (2). A second magnetic core (6) carries three receptive coils for information carrying signals. This information is emitted by three coils (19,20,21).

This arrangement permits separating the transmission of the energy signals on the one hand and the information carriers on the other hand.

5 Claims, 3 Drawing Figures

DEVICE FOR TRANSMITTING SIGNALS BY MAGNETIC INDUCTION TO PROJECTILE FUSE

The present invention relates to a device for transmitting an energy signal by magnetic induction and information carrier signals relative to the method of functioning and/or to the calculated firing delay to a projectile fuse.

Devices are known in which the transfer is effected by means of a single magnetic circuit, the diverse signals being superposed for the emission and filtered or separated at the reception.

According to the present invention there is provided a device for transmitting an energy signal by magnetic induction and information carrier signals relative to the method of functioning and/or to the calculated firing delay to a projectile fuse, this device comprising an outer emitting part and a receptive part inside the fuse, at least two independent magnetic circuits, respectively ensuring the transfer of the energy signal and of the information carrier signals.

The device in accordance with the invention permits more economic construction, the mechanics being smaller and the receptive part necessitating fewer electronic components.

The present invention will be described further, by way of example, with reference to the accompanying drawings, in which.

Figure 1:
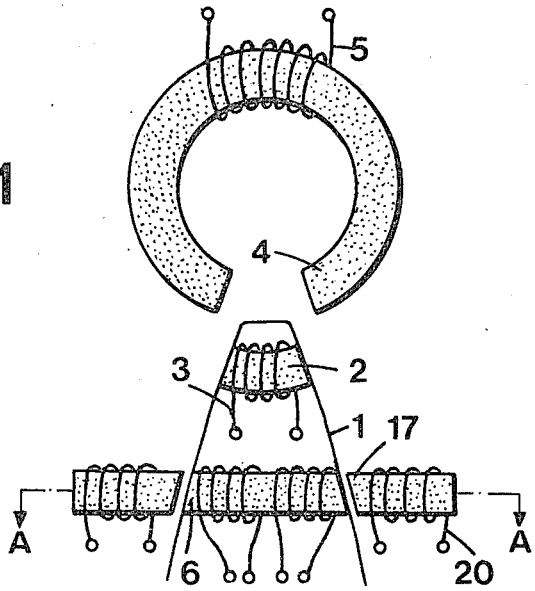
FIG. 1 is an axial section of a first embodiment.

In FIG. 1 there is shown a fuse head 1 inside which there is disposed a first magnetic core 2 carrying a winding 3 adapted to receive an energy signal, by induction, from a magnetic core 4 carrying a winding 5.

Figure 2:
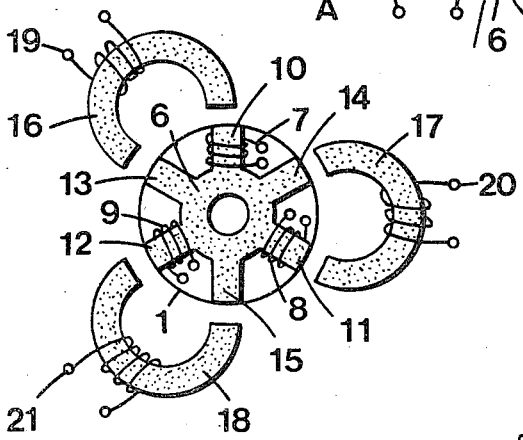
FIG. 2 is a transverse section along the line A—A of the device shown in FIG. 1.

A magnetic core 6 carrying a predetermined number of windings is also disposed inside the fuse 1. This core 6 is, as shown in FIG. 2, in the form of a star having six branches, three of the branches carrying windings 7, 8, 9. Each branch 10, 11 or 12 carrying, respectively, the windings 7, 8 or 9 forms a magnetic circuit with an adjacent branch 13, 14 or 15 and a core 16, 17 or 18 outside the fuse. These cores 16, 17 or 18 respectively carry an information emitter winding 19, 20 or 21. Each magnetic circuit thus formed can be used to transmit information by induction.

For example, one of the circuits can serve to transmit a calculated time delay before firing. Another circuit can receive the calculated delay for the muzzle safety, the third can be used to modify other parameters of the functioning of the fuse. Such a device thus permits the separate transmission of the energy necessary for the fuse after the blast and the different information signals.

This arrangement is particularly useful, as it permits automatic control, by ordinator for example, likewise it permits a re-reading of the information for verification and possible modification.

Figure 3:
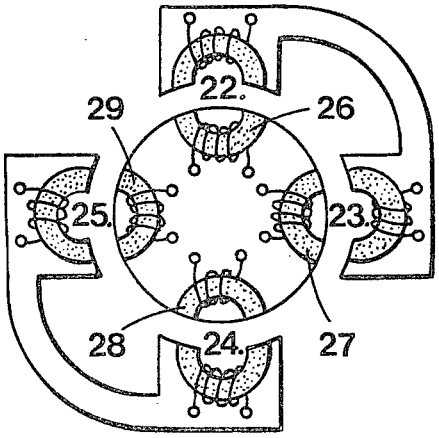
FIG. 3 is a transverse section of a second embodiment.

FIG. 3 shows a variation in accordance with which there are four magnetic circuits 22, 23, 24 and 25 for the transfer of information, the cores 26, 27 28 and 29 carrying the receptive windings being separate but disposed substantially in the same plane normal to the axis of the fuse.

In the two embodiments described it is evident that it is necessary to provide means for the angular positioning of the emitting parts with respect to the receptive parts so that the different emitting windings are correctly placed opposite the receptive windings with which they are associated. In the case of rockets, there could be, for example, an integration of the emitting part of the device of the invention with the maintaining clips.

This device in accordance with the invention is applicable not only to shot fired projectiles but also to approach fuses, timed or percussive, rotating or non-rotating.

We claim:

1. A device for transmitting an energy signal by magnetic induction and information carrier signals relative to the method of functioning and/or to the calculated firing delay to a projectile fuse, said device comprising an outer emitting part and a receptive part inside the fuse, at least two independent magnetic circuits, one of said magnetic circuits being adapted to transfer an energy signal for a power supply, the other magnetic circuit transferring at least one information carrier signal.

2. A device in accordance with claim 1, including one energy transfer magnetic circuit and a number of magnetic circuits equal to the number of information carrier signals to be transmitted.

3. A device for transmitting an energy signal by magnetic induction and information carrier signals relative to the method of functioning and/or to the calculated firing delay to a projectile fuse, said device comprising an outer emitting part and a receptive part inside the fuse, at least two independent magnetic circuits, respectively ensuring the transfer of the energy signal and of the information carrier signals, a number of magnetic circuits equal to the number of information carrier signals to be transmitted, said receptive part comprising a magnetic core carrying a winding adapted to receive the energy signal and a star shaped magnetic core carrying windings respectively adapted to receive an information carrier signal, said emitting part provided with a number of windings equal to that of said receptive part, said windings being disposed in a manner to be placed opposite receptive windings with which they are associated.

4. A device for transmitting an energy signal by magnetic induction and information carrier signals relative to the method of functioning and/or to the calculated firing dely to a projectile fuse, said device comprising an outer emitting part and a receptive part inside the fuse, at least two independent magnetic circuits, respectively ensuring the transfer of the energy signal and of the information carrier signals, a number of magnetic circuits equal to the number of information carrier signals to be transmitted, said receptive part comprising a series of magnetic cores carrying windings respectively adapted to receive an information carrying signal, and a supplementary magnetic core carrying a winding adapted to receive the energy signal, said emitting part provided with a number of windings equal to that of said receptive part, said windings being disposed in a manner to be placed opposite receptive windings with which they are associated.

5. A device in accordance wih claim 4, in which the cores of said series are disposed substantially in the same plane.

* * * * *